US010472800B2

(12) United States Patent
McCabe

(10) Patent No.: US 10,472,800 B2
(45) Date of Patent: Nov. 12, 2019

(54) APPARATUS FOR BACKFILLING A TRENCH

(71) Applicant: DELTA PIPELINE MACHINERY, B.V., Zevenbergen (NL)

(72) Inventor: Keith James McCabe, Slane (IE)

(73) Assignee: DELTA PIPELINE MACHINERY, B.V., Zevenbergen (NL)

( * ) Notice: Subject to any disclaimer, the term of this patent is extended or adjusted under 35 U.S.C. 154(b) by 0 days.

(21) Appl. No.: 16/090,229

(22) PCT Filed: Mar. 31, 2017

(86) PCT No.: PCT/NL2017/050203
§ 371 (c)(1),
(2) Date: Sep. 29, 2018

(87) PCT Pub. No.: WO2017/171552
PCT Pub. Date: Oct. 5, 2017

(65) Prior Publication Data

US 2019/0112785 A1 Apr. 18, 2019

(30) Foreign Application Priority Data

Mar. 31, 2016 (NL) ..... 2016528

(51) Int. Cl.

| | |
|---|---|
| ***E02F 5/22*** | (2006.01) |
| ***B07B 1/12*** | (2006.01) |
| ***B07B 1/00*** | (2006.01) |
| ***B07B 13/16*** | (2006.01) |
| ***E02F 7/06*** | (2006.01) |

(52) U.S. Cl.
CPC ..... *E02F 5/226* (2013.01); *B07B 1/005* (2013.01); *B07B 1/12* (2013.01); *B07B 13/16* (2013.01); *E02F 7/06* (2013.01); *B07B 2201/04* (2013.01)

(58) Field of Classification Search
CPC combination set(s) only.
See application file for complete search history.

(56) References Cited

U.S. PATENT DOCUMENTS

| | | | | |
|---|---|---|---|---|
| 4,664,791 | A * | 5/1987 | McClain | E02F 5/226 209/260 |
| 5,183,160 | A | 2/1993 | McClain | |
| 5,259,699 | A * | 11/1993 | Klamar | E02F 5/226 209/235 |
| 5,769,240 | A * | 6/1998 | Middour | B07B 1/12 209/314 |
| 8,464,874 | B2 * | 6/2013 | Whitley | E01H 12/002 171/111 |
| 8,708,154 | B1 * | 4/2014 | Holmberg | B07B 1/145 209/393 |
| 2015/0129467 | A1 * | 5/2015 | Holmberg | B07B 1/12 209/247 |

* cited by examiner

*Primary Examiner* — Kyle Armstrong
(74) *Attorney, Agent, or Firm* — Robert M. McDermott

(57) ABSTRACT

An apparatus for backfilling a trench and, more particularly, an apparatus for laying a pipeline bed layer in a trench and for laying a pipeline bedding layer once a pipeline is laid in the trench. The apparatus comprises a multi-deck screen vibrating unit. The upper deck screen comprises finger tines or a grizzly arrangement.

19 Claims, 9 Drawing Sheets

APPARATUS FOR BACKFILLING A TRENCH

The present invention relates in general to apparatus for backfilling a trench and, more particularly, to apparatus for laying a pipeline bed layer in a trench and for laying a pipeline bedding layer once a pipeline is laid in the trench.

Such a device is known from U.S. Pat. No. 5,259,699. The known apparatus comprises a feed hopper in which backfilling material can be supplied, a first feeder conveyor for conveying the material from the feeder hopper to a vibrating double decked screen unit, with the upper screen element being of a coarser mesh than the lower screen element. The double decked screen is vibrated. The known device is pulled by a tractor.

A second longitudinally extendable and retractable bedding (fines) conveyor is situated beneath the vibrating screen and receives the fine particulate fraction of the original fill material which has passed pass through the lower screen element.

The extendable and retractable conveyor is translated by a suitable expansible drive means such as hydraulic cylinders, or the like, whose stroke length may be but is not required to be sufficient to traverse the width of the pipeline trench to be backfilled.

U.S. Pat. No. 5,183,160 describes an apparatus that is also pulled by a tractor and positioned on a flat bed trailer. A screening apparatus significantly longer than the width of the trailer, preferably at least two times its width, for screening undesirable materials and objects from excavated earth is mounted on and selectively rotatable in relation to the trailer to either a fixed longitudinal transport mode or at least one fixed transverse operational mode. In the operational mode in the screening apparatus is oriented transverse to the longitudinal axis or direction of movement of the carrier-trailer. Collector apparatus mounted beneath the screening apparatus receives the earth from a discharge at the bottom of the screening apparatus and conveys it to its discharge end. In the operational mode the screening apparatus extends well beyond the trailer and it does not comprise a feed hopper. The device requires much space to the side of the to be filed trench which is not always available.

GB 2468966 describes a screening device used in quarry environments to sort out different sizes materials in a quarry and to provide different piles of materials with different sizes. Various discharge conveyors are used. Said conveyor belts extend upwards so as to discharge at stock piles or on a lorry at various positions, at either side or in front of the screening device. Although such devices have tracks to move the device from one spot to another in the quarry, such devices developed for quarry use are not used or usable for filling a trench since they do not and cannot operate while moving.

The material used for filling the trench may be for instance clay, if the trench is laid in an area in which the ground in which the pipeline is laid is of clay or clay-like.

Clay and especially wet clay is cloggy and tends to clog up the screens.

There is a need for a mobile device for backfilling a trench that is compact, efficient and operable in many situations.

It is an object of the invention to provide an improved apparatus for backfilling a trench.

The apparatus according to the invention is a self-propelled apparatus for backfilling a trench with filler material while moving along a to be filled trench, the apparatus comprising

- a feed hopper, a multi-deck screen vibrating screen unit comprising at least two screens,

- vibrating means for vibrating the multi-deck vibrating screen unit,
- a first means of transport for feeding material from the feed hopper to the multi-deck vibrating screen unit and
- a further means of transport for bringing the filler material exiting the multi-deck vibrating screen unit to the to be filled trench, wherein the multi-deck vibrating screen unit comprises
  - an upper deck comprising finger tines and/or a grizzly screen, preferably finger tines, and
  - at least one lower deck screen below the upper deck and
  - a bottom side below the lower deck screen, the bottom side forming a slide for filler material passing the lower deck screen, wherein the multi-deck vibrating screen unit is tilted parallel to the direction of movement of the self-propelled apparatus, wherein the further means of transport are located at the end of the bottom side for collecting filler material sliding off the bottom side and the upper deck screen and the at least one lower deck screen each extend beyond the further means of transport and wherein the further means of transport extend on either side of the self-propelled apparatus.

The vibrating finger tines or grizzly deck break up clay clumps, thereby preventing or reducing clogging up either the upper or lower deck screen.

The device provides a compact design with a large degree of safety and efficiency. The dimension of the vibrating screen unit with respect to the width of the device is not increased in the operational mode. Clogging up of the screens is reduced.

In preferred embodiments the upper deck screen comprises at an end facing the first conveyor a grizzly structure and at an end remote from the feeding conveyor finger tines.

The part of the upper deck screen facing the feeder conveyor receives the heaviest material and hardest blows and shaping this part in the form of a grizzly screen reduces the risk of damage.

The feeding conveyor for feeding the material from the hopper to the multi-deck vibrating screen unit may be a conveyor belt or a steel plate apron feeder.

Preferably a lower deck screen below the upper deck screen comprises a series of cascade bars, smaller in size and at a smaller distance to each other than the finger tines.

These and further aspects of the invention are described below and illustrated by means of the drawing:

The figures contained in the drawing show the following:

The figures are not drawn to scale; as a rule, like numerals denote like elements.

FIG. 1 illustrates an apparatus according to the invention.

Figure 1:
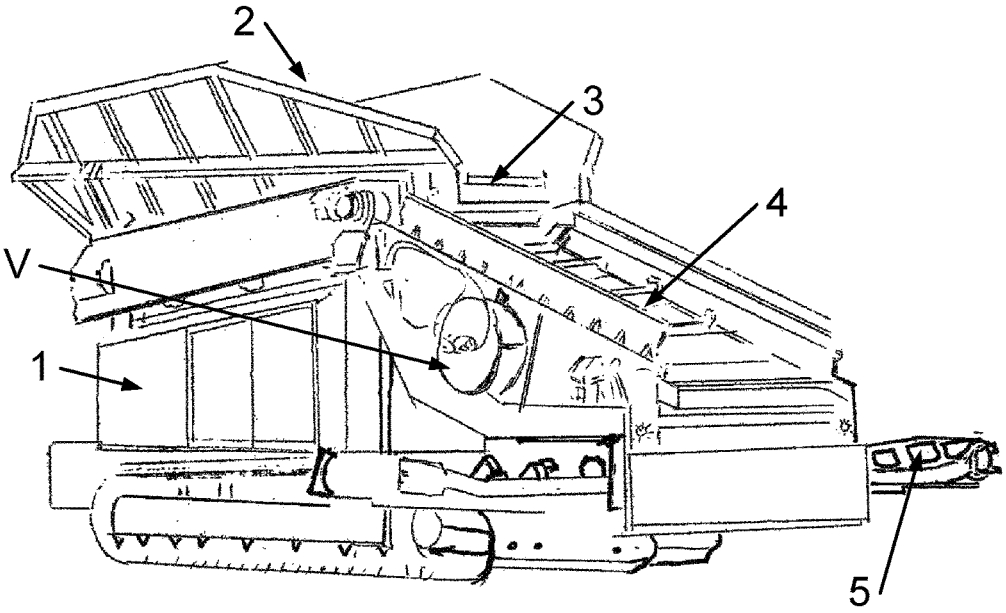
FIG. 1 shows a perspective front view of an apparatus according to the invention

There is a high demand for the laying of underground piping to transport liquids or gas. To lay a pipe of this type, an excavation is usually first made with a back hoe excavator with the excavated rocks and soil piled to one side of the excavation.

Once the trench for the laying of a pipeline has been excavated and water has been extracted, backfilling can commence as proper bedding needs to be put in place before the pipe can be laid.

The layers of back fill can be made of different materials and the main backfill itself can be composed of several layers of different materials. Fine soil is used close to the pipe so as not to damage it and eliminate the risk of rock-to-pipe contact. It is crucial for all the backfill layers close to the pipe to be carefully installed as the soil settlement caused by the load of the main backfill could lead to excessive pressure on the pipe causing deformation. A properly backfilled pipeline trench can considerably extend a pipeline's lifespan.

The financial, environmental, social and logistical problems associated with the importation of selective bedding and backfill materials have contributed to the drive to reuse the excavated material with a positive impact on the cost of projects.

This process is known as padding and, in the past, was a time consuming and expensive stage of laying an underground pipeline.

The padding machine separates the fine material out of spoil which is piled alongside the trench excavation and transports it by conveyor into the excavation, thereby padding the pipeline.

The types of spoil generated during excavation depend on location, depth, and the method used and frequently includes wet sticky material, large boulders or large frozen lumps of soil. Various materials may be encountered when excavating a trench, such as large boulders, wet sticky material and/or large clumps of clays. The material may change along the length of a trench wherein for instance at some parts along the trench rocky material is found, whereas further along the trench wet sticky material is found and/or clay.

There has existed a long and unfilled need for a padding machine which is adaptable to various types of excavated material and is effective in demanding screening conditions.

The present invention aims to provide such an apparatus

The apparatus 1 for backfilling a trench and, more particularly, to apparatus for laying a pipeline bed layer in a trench and for laying a pipeline cover layer once a pipeline is laid in the trench comprises a feed hopper 2. The apparatus shown is a self-propelled apparatus which moves along a to be filed trench and fills the trench while moving along the trench. A first conveyor 3, which may be a conveyor belt or a steel plat apron, is provided for feeding the material from the feed hopper 2 to the multi-deck vibrating screen unit 4. Below the multi-deck vibrating screen unit 4 a second conveyor 5 is situated for bringing the material exiting the multi-deck vibrating screen unit 4 to back fill the trench. The device is in this example self-propelled and provided with caterpillar tracks. The apparatus moves along a trench in which for instance a pipeline is provided. The apparatus is to able to travel and process material on its own power at the same time. Material is provided in the feeder hopper and padding material is via the conveyor brought in the trench to cover the pipeline. The apparatus moves along the trench.

The first conveyor or feeder 3 may be for example:

Belt feeder: This is a continuous flat, rubber conveyor belt between two drums and supported on idlers. They can be variable speed and are recognised as being highly accurate means of controlling flow rates.

Apron feeder: This type of feeder is heavy duty, robust and designed to handle heavy shock loads and wet sticky materials.

The side conveyor 5 is preferably retractable and can fold up on both sides for transporting. For example, a speed controlled 800 mm wide belt can extend on either side and be equipped with a hydraulic adjustable head deflector. These features facilitate adjusting the material flow and direction into the trench. The second conveyor 5 is oriented substantially horizontal and transports the material 9 that has slid down the bottom side 6 of the multi-deck vibrating 4 and has fallen on the conveyor 5 sideways to a to be filled trench. The side conveyor 5 extends at both sides of the self-propelled apparatus and can transport material to either of the sides of the self-propelled apparatus as it moves along a trench. The side conveyor 5 is preferably a variable speed horizontal discharge conveyor which can be operated in either direction and can be shuttled out on either side. This feature enables shuttling the conveyor over the trench on either side, which combined with the hydraulically adjustable head deflector, facilitates the placement of the material in the trench. The side conveyor 5 is preferably able to slide closer and further to the trench and is able to turn both clockwise and counter-clockwise.

Figure 2:
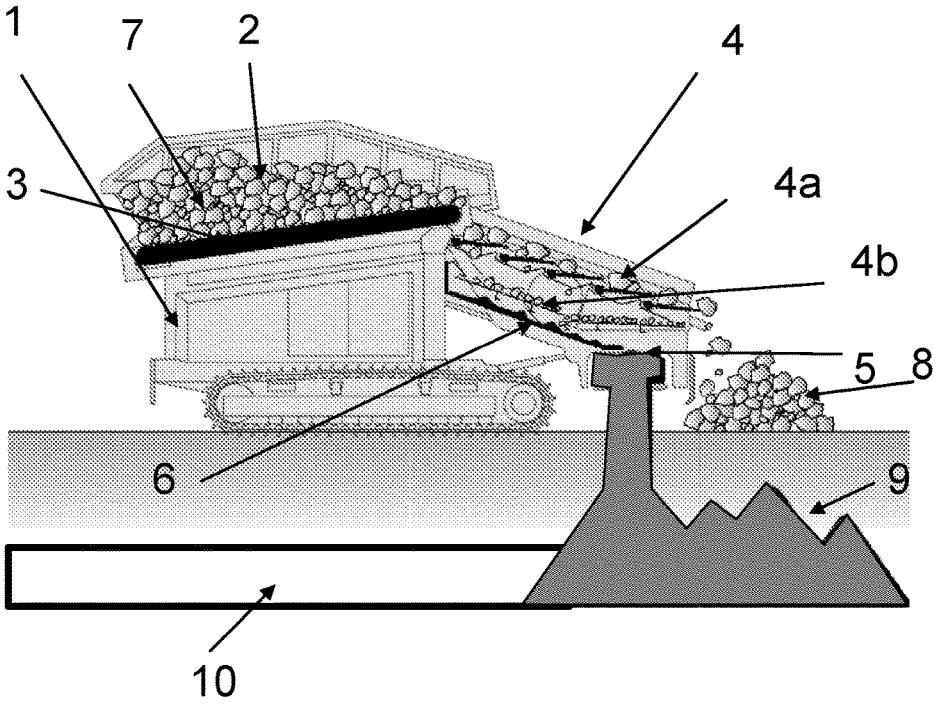
FIG. 2 shows the apparatus of FIG. 1 in cross section.

FIG. 2 shows that the multi-deck vibrating screen unit comprises more than one, in this example two, screens decks, an upper deck screen 4*a* and at least one lower deck screen 4*b*. The material that passes the lowest deck screen 4*b* slides down the bottom side 6 of the unit 4. The slide 6 (or chute) is part of the multi-deck vibrating screen unit 4 and being a part of the multi-deck vibrating screen unit 4 is, in operation, also vibrating. The material 7 that is fed into the hopper 2 is segregated into waste material 8 and filler material 9. Said filler material 9 is via second conveyor 5 filled in the trench in which in this example a pipeline 10 is present. The pipeline 10 is covered with material 9. The apparatus is provided with vibrating means V for vibrating the multi-deck vibrating screen unit (4). The multi-deck vibrating screen unit 4 is tilted parallel to the direction of motion of the apparatus. Preferably hydraulic means are provided to adjust the angle of tilt. This enables to compensate for variations in the gradient of the terrain while maintaining the operating angle of the multi-deck vibrating screen unit 4.

The multi-deck vibrating screen unit 4 facilitates interchangeability between various upper and lower deck-screen configurations depending on the nature of the raw material fed into the feed hopper. Various raw materials can be handled with ease. The upper deck-screen 4*a* can be a welded mesh or finger tines, or grizzly bars, but preferably finger tines and/or grizzly bars, the lower deck may be a screen mesh or cascade finger bars or a self-cleaning screen mesh. The versatile multi-deck vibrating screen unit greatly reduces the possibility of oversize material contaminating the filler material 9 with costly consequential damage to the pipeline 10 while also reducing the risk of clogging up of a deck-screen, thus reducing down-time of the apparatus and improving efficiency.

Figure 3A:
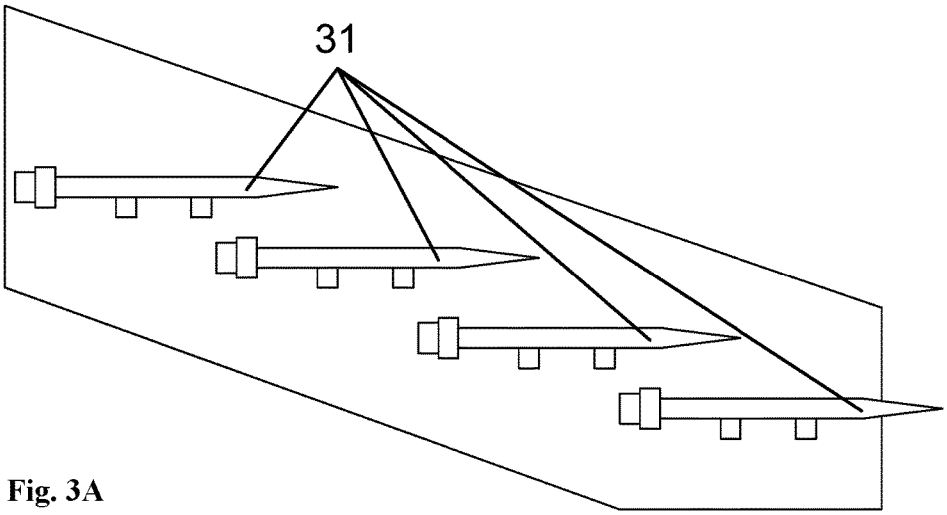
FIGS. 3A, 3B (collectively FIG. 3) shows an upper deck with finger tines.
Figure 3B:
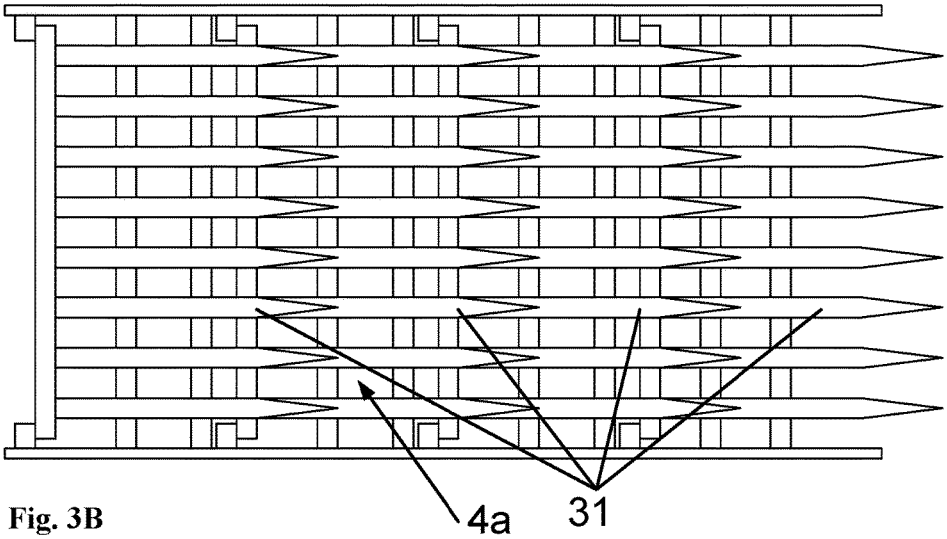

FIG. 3 shows a preferred embodiment of the upper deck screen 4*a* of the apparatus according to the invention. In this embodiment the upper deck screen comprises finger tines 31. A number of rows of finger tines 31 in a cascade arrangement are provided.

Finger bar screens operate as a linear or circular vibrating screen. The top deck finger tines are preferably made from high quality abrasion resistant material capable of taking the abuse other padding machines throw directly on the main screen deck.

This deck is designed to eliminate clogging and sift out hard, potentially damaging, large boulders and wet sticky clay.

This protects the lower screen deck from impact damage and greatly reduces the possibility of large/oversize boulders penetrating the screen cloth and contaminating the padding material with costly consequential damage to the pipe.

Figure 4A:
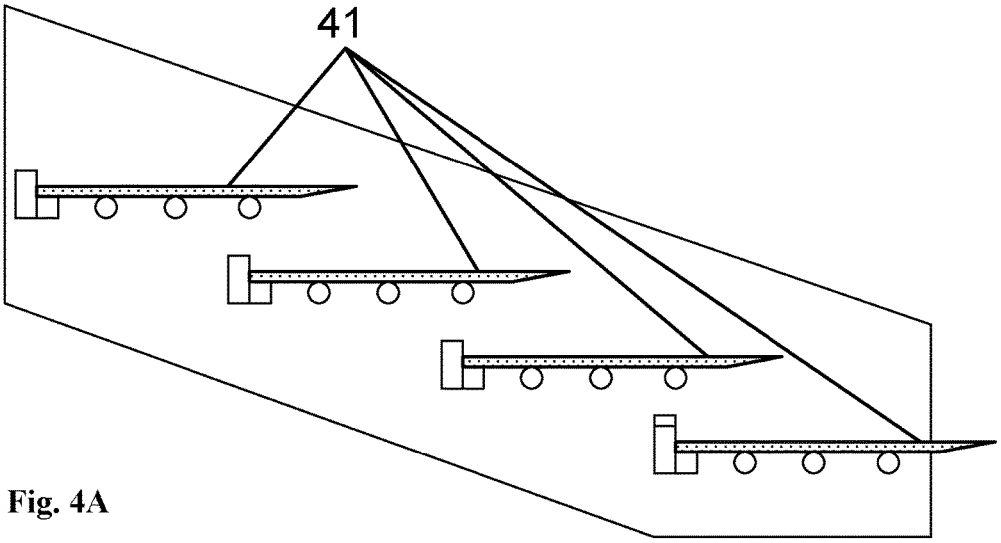
FIGS. 4A, 4B (collectively FIG. 4) shows an upper deck in a grizzly arrangement.
Figure 4B:
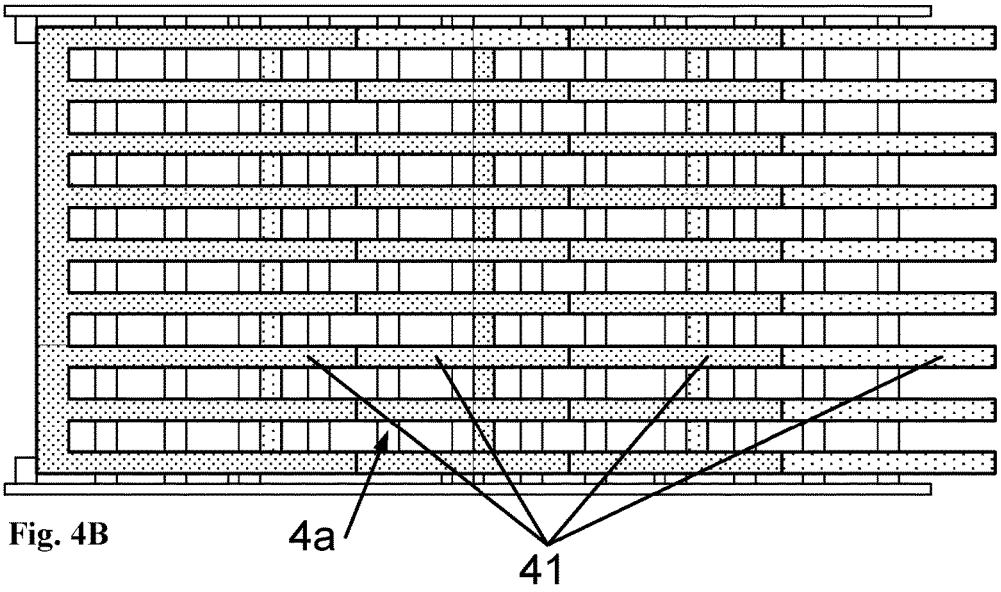

Finger tines form a large number of vibrating elements, compared to a grizzly arrangement as shown in FIG. 4, which vibrates more like a single entity. The multitude of vibrating elements formed by the vibrating finger tines have the beneficial effect of a fast break-up of material thrown on the upper deck screen. This is particularly advantageous when wet material, in particular wet clay is being used for padding.

FIG. 4 shows an upper deck screen in a grizzly arrangement. A number of grizzly bars 41 is provided in a cascade arrangement. Grizzly Screens consist of parallel bars, are robust, vibrating, linear-motion and are designed for heavy-duty scalping, and the removal of finer product from the feed material.

A further preferred embodiment is one wherein the upper deck screen has grizzly bars at the receiving end if the raw material is very robust and finger tines at the discharge end to sort remaining wet sticky material.

Figure 5A:
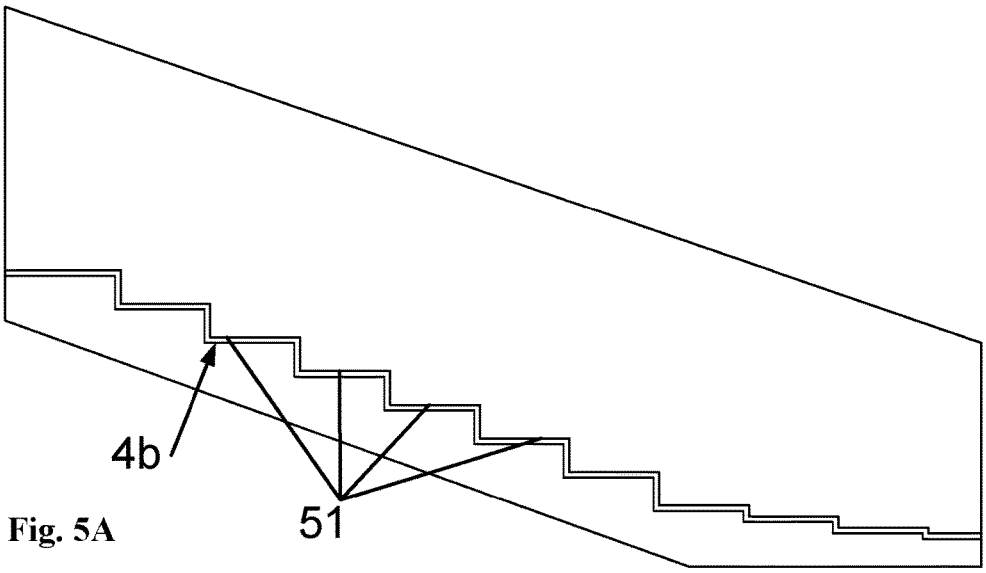
FIGS. 5A, 5B (collectively FIG. 5) shows a lower deck with a cascade bar arrangement.
Figure 5B:
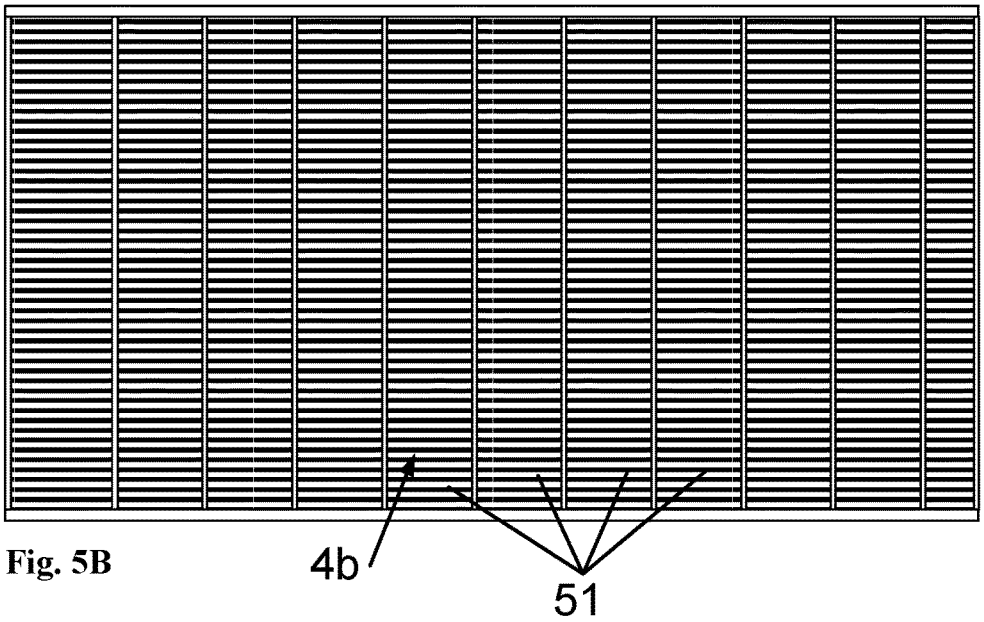

FIG. 5 shows a lower deck screen 4*b* of an embodiment of the invention.

In this embodiment the lower deck screen is provided with a series of cascade bars 51, smaller is size and at smaller distance to each other than the finger tines 31. This is a preferred embodiment. The lower deck screen may alternatively be formed of a woven wire mesh; Woven wire mesh is versatile and is a good choice for applications that require precision and strength.

Figure 6A:
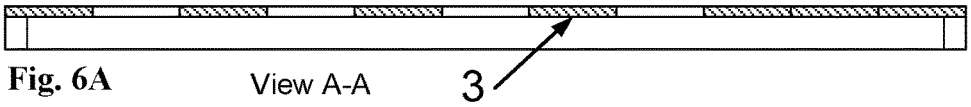
FIGS. 6A, 6B (collectively FIG. 6) shows a steel plate apron feeder.
Figure 6B:
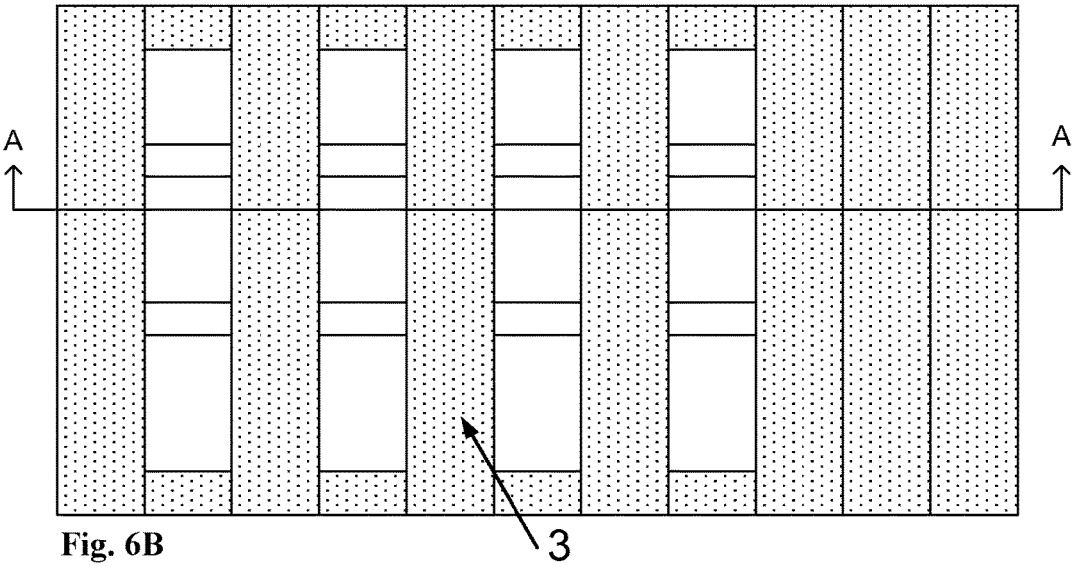

FIG. 6 shows a steel plate apron feeder. In embodiments this is used for feeding the material from the hopper 2 to the multi-deck vibrating screen unit 4.

Figure 7:
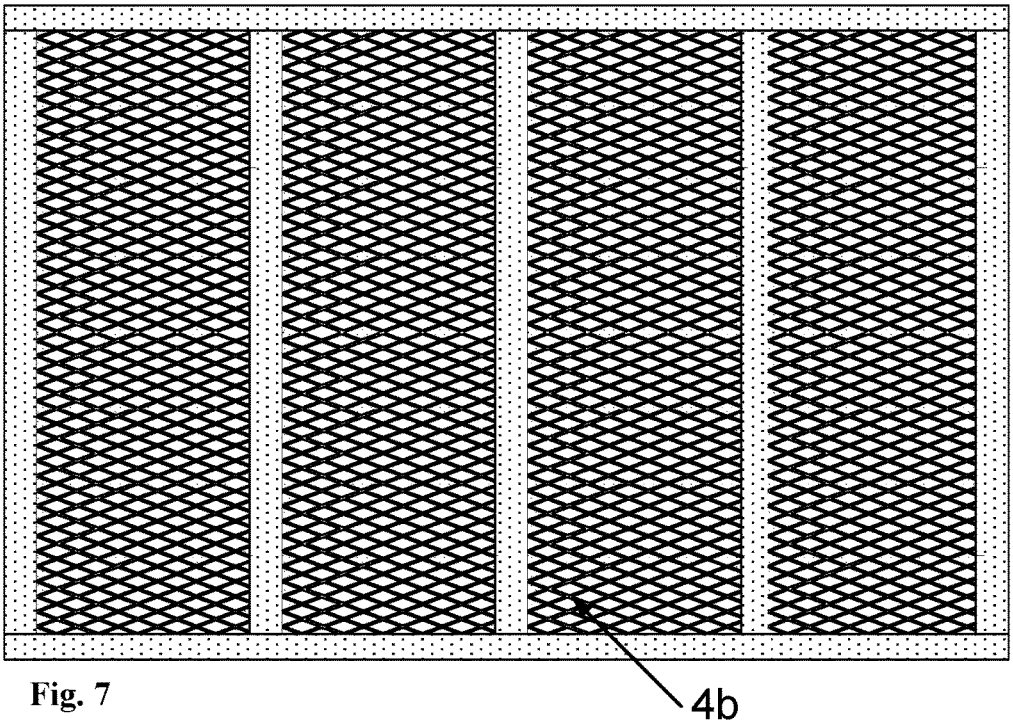
FIG. 7 shows a selfcleaning bottom deck screen mesh.

FIG. 7 shows a lower deck screen comprising a self cleaning bottom deck screen Mesh. This is particularly useful when the filling material is wet clay.

The combination of an upper deck comprising rows of finger tines as shown in FIG. 3 and a lower deck having cascaded bars 51 as shown in FIG. 5 is most efficient.

Figure 8:
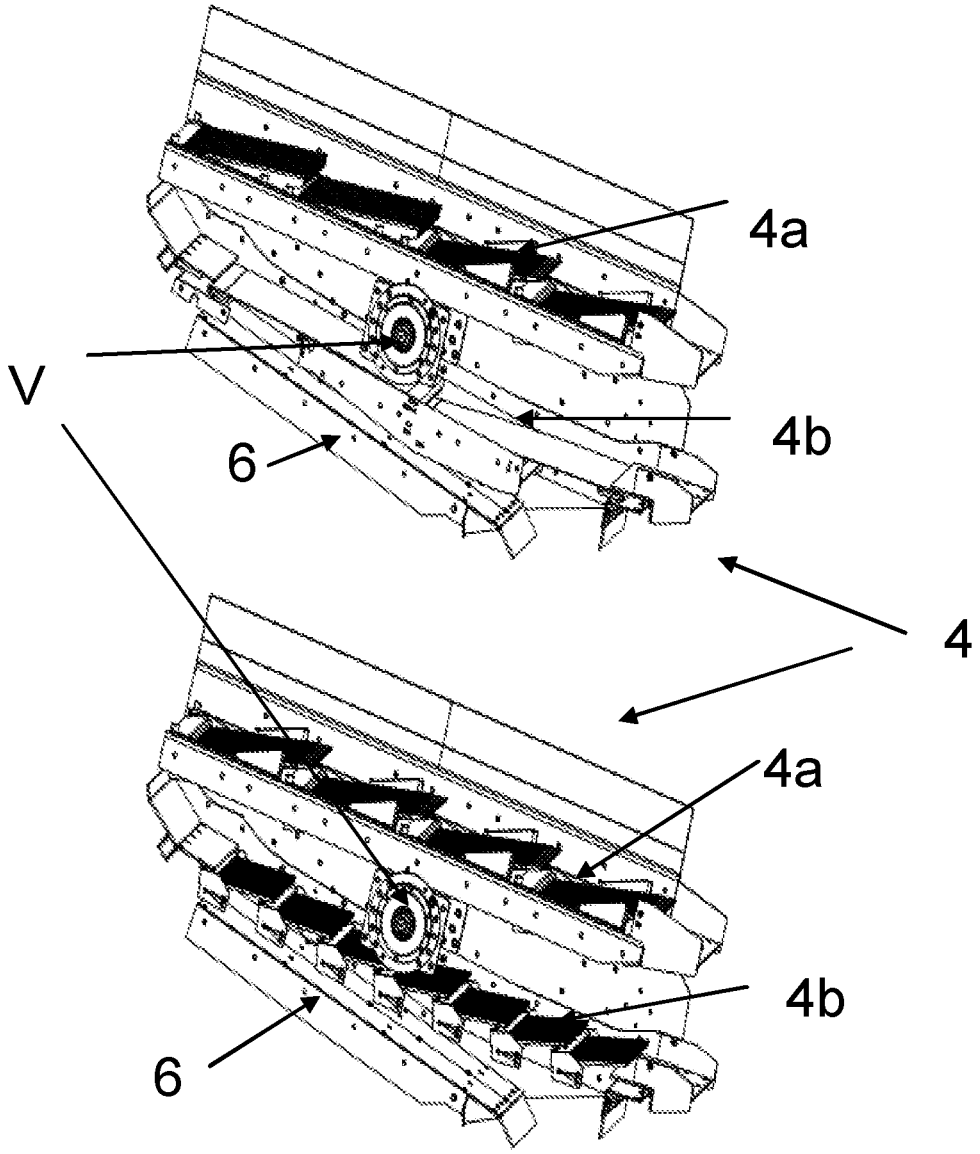
FIG. 8 shows a multi-deck vibrating screen unit in more detail.

FIG. 8 illustrates a multi-deck verbrating screen unit 4. The multi-deck vibrating screen unit comprising an upper deck 4*a*, a lower deck 4*b*, and a bottom side 6, which bottom side acts as a slide for material that has passed the screens 4*a* and 4*b*. The multi-deck vibrating screen unit 4 is vibrated by the vibration means V. Filler material that has passed the upper and lower screen slides off the bottom side 6 to be collected by transport means 5, not shown in FIG. 8. The sideways extending transport means 5 transport the filler material to the left or right depending on how the self-propelled apparatus 5 moves along the trench. FIG. 8 shows that the vibrating means are positioned in between the upper and lower deck, e.g. an eccentric shaft of the vibrating means is in between the upper and lower deck. This provides for a more symmetric distribution of the load during processing and a more efficient use of the vibrating power. Positioned in between means that, seen in a direction substantially transverse to the upper and lower deck the points or surfaces at or with which the vibrating means are attached to the screen unit are lower than the upper deck and higher than the lower deck.

Figure 9:
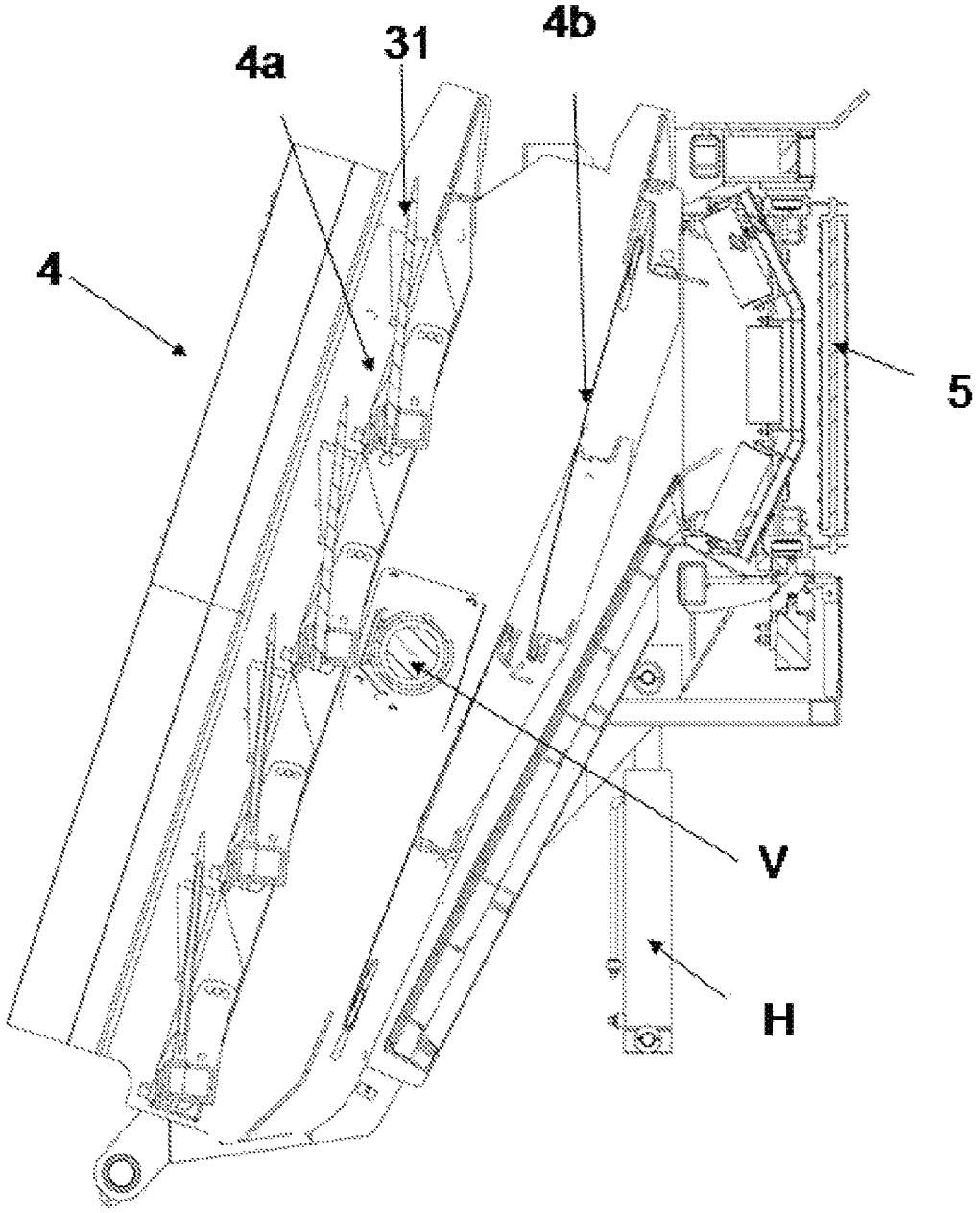
FIGS. 9 to 11 show details of embodiments of the invention.
Figure 10:
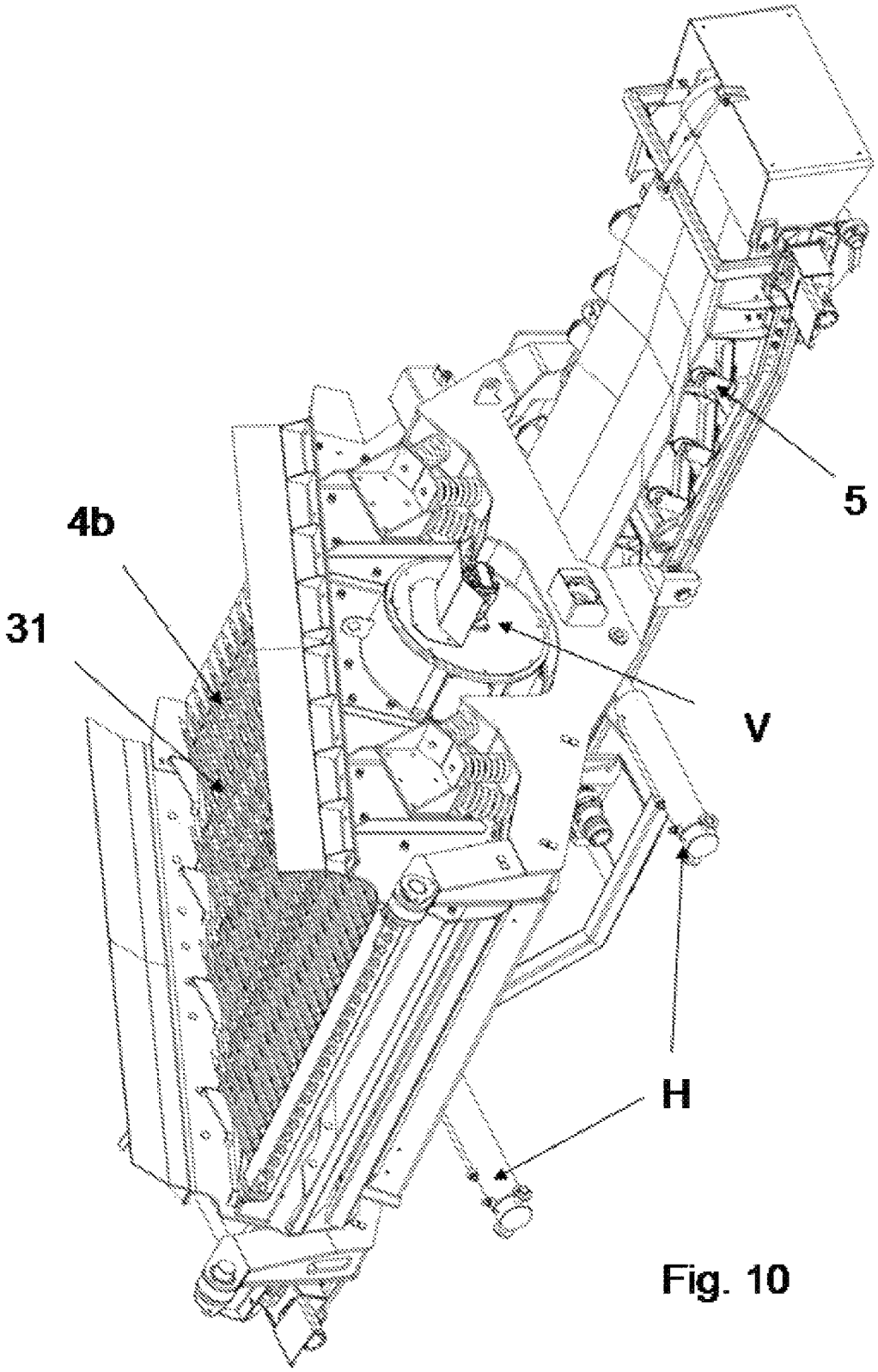

FIGS. 9 and 10 show that in preferred embodiments the screen unit and the further transport means are tilted by means of a hydraulic tilting mechanism H. This enables to compensate for variations in the gradient of the terrain while maintaining the operating angle of the multi-deck vibrating screen unit 4 and also to keep the further transport means 5 at a horizontal level.

The invention is also related to a method of backfilling a trench and, more particularly, of laying a pipeline bed layer in a trench and in particular laying a pipeline covering layer once a pipeline is laid in the trench.

In said method a self-propelled apparatus 1 for backfilling a trench moves along a to be filled trench and raw material is fed into a feed hopper and is transported by transport means to a multi-deck vibrating screen unit, and while moving, the raw material is segregated in the multi-deck vibrating screen unit into waste material 8 and filler material 9, the filler material 9 slides of the bottom 6 of the vibrating unit 4 onto a further transport means 5 and the filler material 9 is transported sideways to a to be filled trench by the further transport means 5 wherein the waste material 8 exits the vibrating unit 4 at an end of the vibrating unit 4 beyond the further transport means 5.

It will be clear that the invention is not limited to the examples provided here. Any combination of features may be used.

Various embodiments are possible. The upper deck finger bars are preferable variable pitch which means they can rotate to 3 different positions to change the angle.

The lower deck cascade bars are also preferably variable pitch which means they can rotate to 3 different positions to change the angle.

Figure 11:
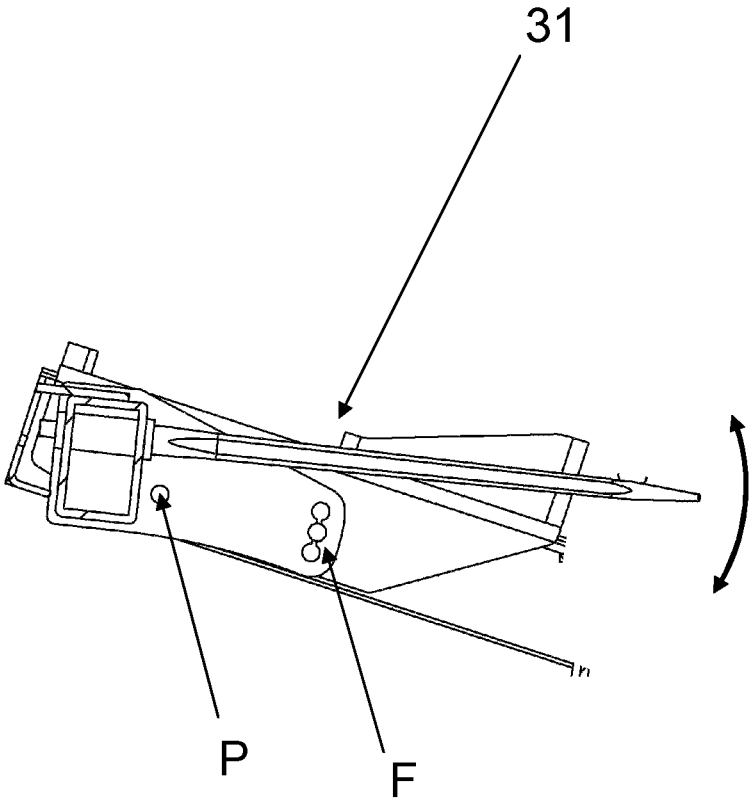

FIG. 11 illustrates such a preferred embodiment. The angle of the finger tines 31, in this embodiment of the upper deck can be adjusted. A pivot point P is provided and in this example three fixing points F (for instance holes for a bolt) are provided which can commute with a fixed hole behind the three fixing points F. By tilting the finger tines 31 and sticking bolts into one of the three holes to fix the position three different angles can be obtained thereby adjusting the tilt angle of the finger tines.

The invention claimed is:

1. An apparatus for backfilling a trench with filler material while moving alongside the trench, the apparatus comprising:

an integral propulsion element that enables the apparatus to be a self-propelled apparatus;

a feed hopper that receives raw material that includes elements of different sizes;

a multi-deck vibrating screen unit that segregates the material into waste material and filler material;

a vibrator that vibrates the multi-deck vibrating screen unit;

a first conveyor that transports the raw material from the feed hopper to the multi-deck vibrating screen unit in a first direction that is parallel to a direction of travel of the self-propelled vehicle; and a second conveyor that transports the filler material to the trench in a second direction that is orthogonal to the first direction;

wherein:

the multi-deck vibrating screen unit comprises an upper deck screen, at least a lower deck screen below the upper deck screen, and a bottom surface below the lower deck screen that receives the filler material;

the upper deck screen comprises a plurality of elongated members upon which the raw material is deposited;

the plurality of elongated members comprises at least one of a plurality of finger tines and a plurality of grizzly bars that segregates the raw material into a first part of the waste material and screened material;

the lower deck screen segregates the screened material into a second part of the waste material and the filler material;

the bottom surface forms a slide that transports the filler material to the second conveyor; and the second conveyor is selectively adjustable to extend beyond either side of the self-propelled apparatus.

2. The apparatus of claim 1, wherein the plurality of elongated members comprises cascaded sets of elongated members.

3. The apparatus of claim 2, wherein the plurality of elongated members comprises a plurality of finger tines.

4. The apparatus of claim 3, wherein the tines of the plurality of finger tines vibrate substantially independent of each other.

5. The apparatus of claim 2, wherein the plurality of elongated members comprises a plurality of grizzly bars.

6. The apparatus of claim 2, wherein the plurality of elongated members includes a plurality of grizzly bars and a plurality of finger tines.

7. The apparatus of claim 1, wherein the plurality of elongated members comprises a plurality of finger tines.

8. The apparatus of claim 1, wherein the plurality of elongated members comprises a plurality of grizzly bars.

9. The apparatus of claim 1, wherein the plurality of elongated members includes a plurality of grizzly bars and a plurality of finger tines.

10. The apparatus of claim 1, wherein the lower deck screen comprises a woven wire mesh.

11. The apparatus of claim 1, wherein the lower deck screen comprises a self-cleaning screen.

12. The apparatus of claim 1, wherein the lower deck screen comprises a plurality of elongated elements, and wherein a spacing between the elongated elements of the lower deck screen is smaller than a spacing between the elongated members of the upper deck screen.

13. The apparatus of claim 12, wherein the plurality of elongated elements comprises cascaded sets of elongated elements.

14. The apparatus of claim 12, wherein an angle of the plurality of elongated elements relative to a plane of the lower deck screen is adjustable.

15. The apparatus of claim 1, wherein an angle of the plurality of elongated members relative to a plane of the upper deck screen is adjustable.

16. The apparatus of claim 1, wherein the multi-deck vibrating screen is tilted on an axis that is perpendicular to a direction of motion of the self-propelled apparatus.

17. The apparatus of claim 16, wherein an angle of tilt of the multi-deck vibrating screen is adjustable.

18. The apparatus of claim 1, wherein the vibrator is situated between the upper deck screen and the lower deck screen.

19. A method of backfilling a trench with filler material comprising:

situating a self-propelled apparatus adjacent the trench;

providing raw material to a feed hopper of the apparatus;

operating the apparatus to segregate the raw material into waste material and filler material, wherein a size of the filler material is smaller than a size of the waste material;

situating an end of a discharge conveyor to discharge the filler material into the trench; and moving the apparatus in a direction of the trench;

wherein the apparatus comprises:

the feed hopper;

a multi-deck vibrating screen unit that segregates the material into the waste material and the filler material;

a vibrator that vibrates the multi-deck vibrating screen unit;

a raw material conveyor that transports the raw material from the feed hopper to the multi-deck vibrating screen unit in a first direction that is parallel to a direction of travel of the self-propelled vehicle; and the discharge conveyor that transports the filler material from the multi-deck vibrating screen unit to the trench in a second direction that is orthogonal to the first direction; and wherein:

the multi-deck vibrating screen unit comprises an upper deck screen, at least a lower deck screen below the upper deck screen, and a bottom surface below the lower deck screen that receives the filler material;

the upper deck screen comprises a plurality of elongated members upon which the raw material is deposited;

the plurality of elongated members comprises at least one of a plurality of finger tines and a plurality of grizzly bars that segregates the raw material into a first part of the waste material and screened material;

the lower deck screen segregates the screened material into a second part of the waste material and the filler material;

the bottom surface forms a slide that transports the filler material to the second conveyor; and the discharge conveyor is selectively adjustable to extend beyond either side of the self-propelled apparatus.

* * * * *